United States Patent [19]

LaFleur

[11] Patent Number: 4,518,106

[45] Date of Patent: May 21, 1985

[54] COLLAPSIBLE BAG AND DISCHARGE VALVE THEREFOR

[75] Inventor: Arthur E. LaFleur, Manistee, Mich.

[73] Assignee:. Custom Packaging Systems, Inc., Manistee, Mich.

[21] Appl. No.: 612,456

[22] Filed: May 21, 1984

[51] Int. Cl.[3] ..... B65D 88/26

[52] U.S. Cl. ..... 222/460; 222/105; 222/559; 222/567; 222/181

[58] Field of Search ..... 222/527, 528, 529, 530, 222/181, 185, 460, 461, 105, 173, 544, 545, 559, 567; 383/67

[56] References Cited

U.S. PATENT DOCUMENTS

| | | | |
|---|---|---|---|
| 367,599 | 8/1887 | Conant | 222/559 |
| 3,255,927 | 6/1966 | Rupert et al. | 222/185 |
| 4,167,235 | 9/1979 | Green | 222/105 |
| 4,194,652 | 3/1980 | Williamson et al. | 222/185 |
| 4,442,956 | 4/1984 | Carlsson | 222/529 |

*Primary Examiner*—Joseph J. Rolla
*Assistant Examiner*—Nils E. Pedersen
*Attorney, Agent, or Firm*—Barnes, Kisselle, Raisch, Choate, Whittemore & Hulbert

[57] ABSTRACT

A large bulk bag is provided with a flexible tubular spout at its lower end. A valved casing is detachably suspended from the lower end of the bag beneath and in alignment with the bag's spout. The bag spout, when opened, is designed to extend into the valved casing and, thus, permit the contents of the bag to be discharged in desired metered amounts.

15 Claims, 9 Drawing Figures

FIG. 6
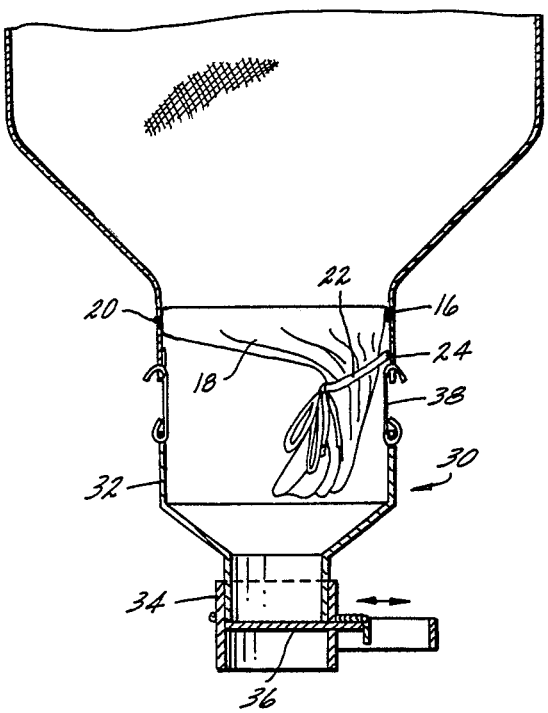
FIG. 7
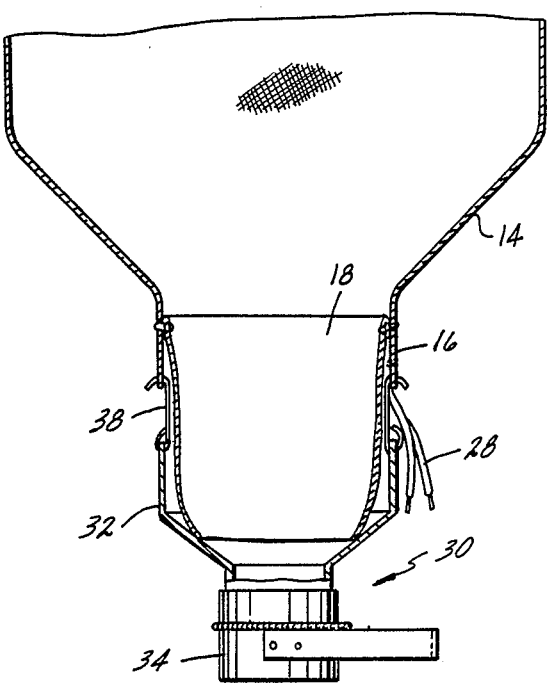
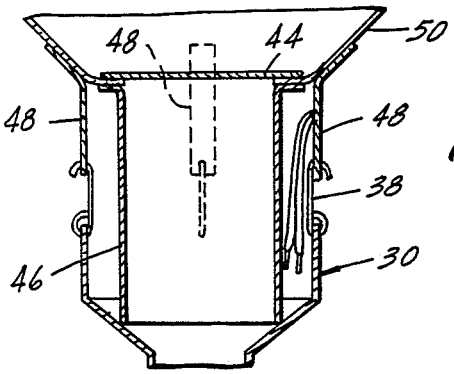
FIG. 9
FIG. 8
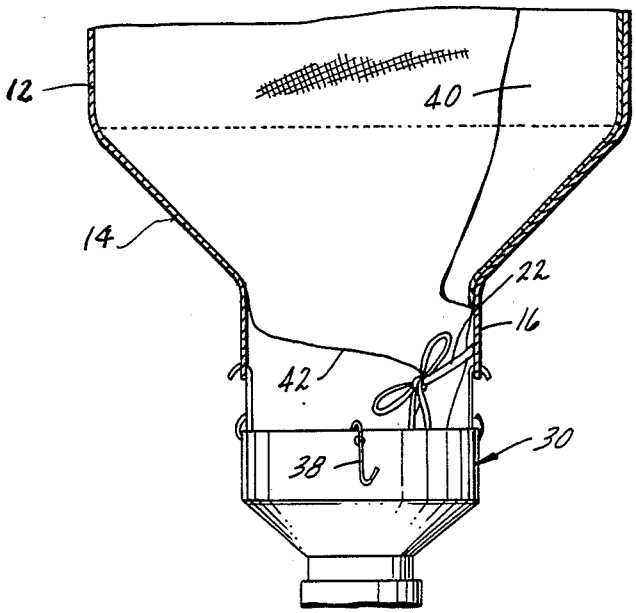

COLLAPSIBLE BAG AND DISCHARGE VALVE THEREFOR

This invention relates to a discharge valve for a large bulk bag.

In recent years large collapsible bulk bags made of a fabric material, such as woven plastic, have come into prominent usage for shipping various granular materials, such as feed, fertilizer, resins, etc. Such bags are provided with a spout at one or both ends for filling the bag and for discharging the contents thereof. The spouts are normally gathered and tied in some fashion to close the bag and untied to discharge the contents thereof. As a practical matter, the upper and lower ends of the bags must be constructed so that the bags can be stacked vertically directly upon one another.

The filled bags are shipped to the user, who, to discharge the contents thereof, suspends the bag over a large hopper, opens the spout at the lower end of the bag and allows the contents thereof to flow into the hopper. The empty bag is discarded or returned to the product supplier in a collapsed compact condition. The hopper into which the bag contents are discharged normally has a valve at the lower end thereof for allowing the contents to be discharged as needed in desired amounts into smaller containers. While this arrangement for shipping products in bags and discharging the product into hoppers represents a savings in cost over shipping such products and manually or otherwise dispensing them from large rigid containers, such as drums, boxes, etc., it still requires the use of large, costly hoppers.

The primary object of this invention is to eliminate the need for large hoppers into which the contents of large bulk bags are normally discharged.

A more specific object of this invention is to enable the contents of such bags to be discharged in desired small metered amounts directly therefrom.

A further object of this invention is to provide a bag construction which enables a small inexpensive valved casing to be suspended directly from the bag below the spout thereof to enable discharging the contents of the bag in desired metered amounts directly into other containers.

A still further object of this invention is to form a discharge spout on the large bulk bag that is designed to be automatically disposed in sealed engagement with a small valved casing suspended from the bag when the spout is opened.

Other objects, features and advantages of the present invention will become apparent from the following description and accompanying drawings, in which:

FIG. 6 is a sectional view showing the valved casing suspended from the boot of the bag while the bag spout remains in the gathered and tied closed condition;

FIG. 7 is a view similar to FIG. 6 and showing the spout in the opened position extending into the valved casing;

FIG. 8 is a view similar to FIG. 6 and showing a liner within the bag, the lower end of the liner forming the discharge spout for the bag; and FIG. 9 is a fragmentary sectional view showing an alternate method for suspending the valved casing from the lower end of a bag.

Figure 1:
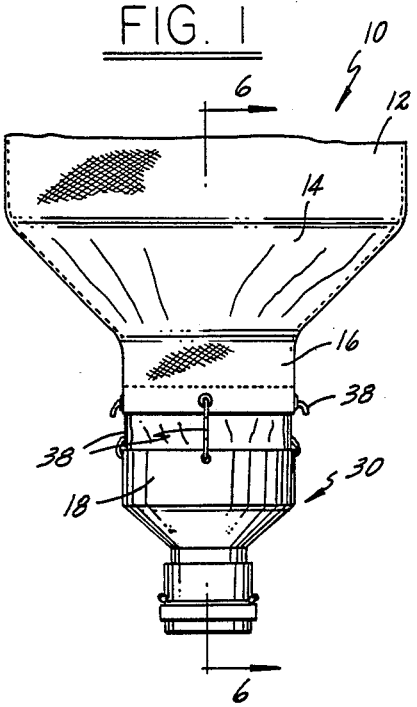
FIG. 1 is a fragmentary side elevational view of a large bulk bag from which a valved casing is suspended in accordance with the present invention.

The collapsible bag involved in this invention is generally designated 10 and is preferably formed of a fabric material so that it can be collapsed and folded into a compact form. In its preferred form the bag has the configuration and construction shown in copending U.S. patent application Ser. No. 06/528,604, filed Sep. 1, 1983 and assigned to the assignee of this application. The bag is preferably of generally rectangular cross section, having four side walls 12 and a bottom wall defined by four panels 14 which incline downwardly toward each other from the lower ends of the side walls 12 to a four-sided boot 16. Within boot 16 there is secured a spout 18 as shown in FIGS. 6 and 7. Spout 18 is also formed as a fabric member. The upper peripheral edge of spout 18 may be stitched to the inside of boot 16 as at 20. A tie cord 22 is attached to the inside of boot 16 as at 24. Spout 18 can be collapsed by gathering it together and securing it in this gathered position by tie cord 22. When so collapsed, the tied spout serves to close the lower end of the bag.

Figure 2:
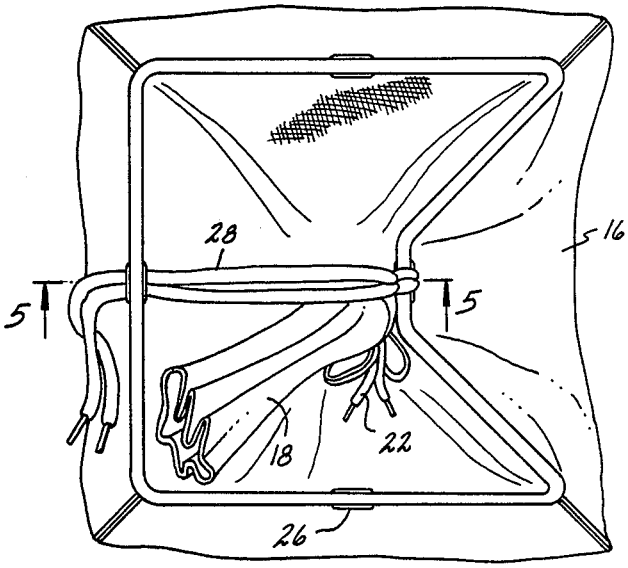
FIGS. 2, 3 and 4 illustrate successive steps employed for closing the boot at the lower end of the bag.
Figure 3:
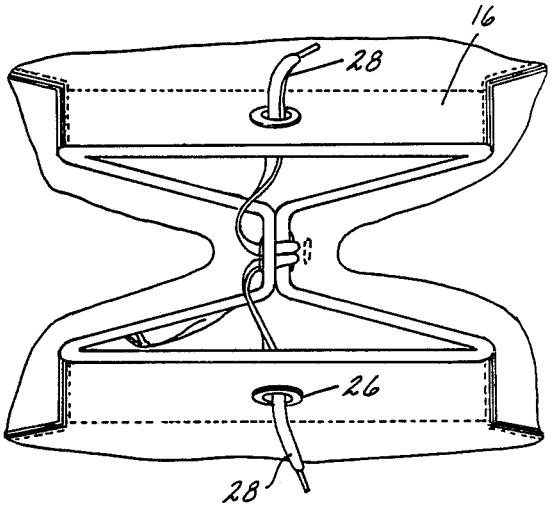
Figure 5:
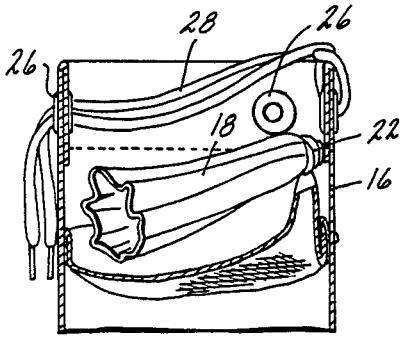
FIG. 5 is a fragmentary sectional view taken along the line 5—5 in FIG. 2.
Figure 4:
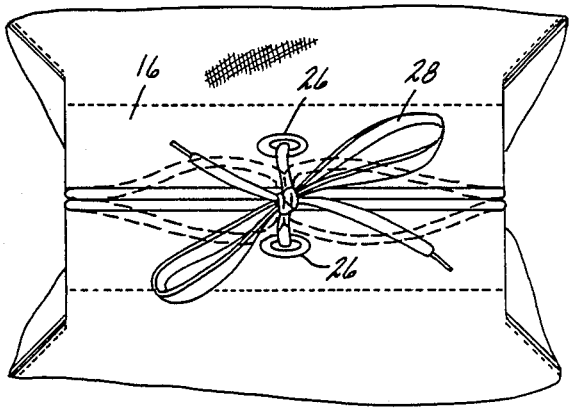

The lower end of boot 16 has four grommets 26 secured thereto, one at each of the four sides thereof. These grommets serve a dual purpose. After the spout 18 is gathered and tied as shown in FIG. 6, a lace 28 can be threaded through the grommets 26 in a manner to fold each of the four sides of boot 16 upwardly and laced together in the manner illustrated in FIGS. 2 thru 5. Lace 28 is first extended through one of the grommets 26 and then both ends of the lace are threaded through the diametrically opposite grommet 26 as shown in FIG. 2. The lace is then tightened so that the two opposite side walls of the boot through which it extends are folded upwardly and drawn together. Thereafter one end of lace 28 is extended through one of the remaining grommets and the other end of the lace is extended through the other remaining grommet as shown in FIG. 3. When the two ends of the laces are then tightened the remaining two sides of boot 16 are folded upwardly and the ends are tied together as shown in FIG. 4. In this condition the boot is closed and underlies the tied spout 18. This is the condition of the bag when it is initially filled with product and shipped to the user.

To dispense the contents of the bag the user supports it in an elevated position and unties the lace 28 so that the boot 16 extends downwardly as shown in FIGS. 6 and 7. He then suspends a casing 30 from boot 16. Casing 30 comprises an upper hopper section 32 and a lower spout section 34 in which any suitable valve 36 is arranged for opening and closing the passageway defined by spout section 34.

Four hooks 38 are spaced around the upper periphery of hopper section 32 so as to be generally vertically aligned with the four grommets 26 around boot 16. Hooks 38 are on the order of three to four inches long so that, when casing 30 is suspended from the boot as shown in FIGS. 1, 6 and 7, the upper edge of casing 30 is spaced below the lower end of boot 16 sufficiently to enable the user's hand to be inserted therebetween for the purpose of loosening tie cord 22. With the casing suspended in this manner, when tie cord 22 is loosened, the weight of the contents within the bag causes the spout 18 to open and extend downwardly into the hopper section 32 of the casing. From FIG. 7 it will be observed that spout 18 has a length substantially greater than boot 16 and is sufficiently long as to extend downwardly well into the hopper section 32 of casing 30. When the spout is opened by releasing tie cord 22 the material in the bag will flow downwardly to fill the hopper and cause the lower end portion of the spout to engage and seal against the inner periphery of hopper section 32. Thereafter the contents of the bag can be dispensed in any amount desired by simply manipulating valve 36 to open and close the discharge spout section 34 of casing 30.

In the embodiment illustrated in FIGS. 1 thru 7 spout 18 comprises a relatively short tubular member stitched to boot 16 as at 20. In the case of some materials, such as food stuffs that require aseptic conditions, the bag may be provided with a plastic liner 40 as illustrated in FIG. 8. In this case, the discharge spout for the bag can be formed as a discharge spout 42 at the lower end of liner 40. Spout 42 functions in the same manner as spout 18 previously described.

While the provision of a boot on the bag such as shown at 16 is preferred, the invention also has utility in connection with other bags now being used commercially that are not provided with such a boot. For example, as shown in FIG. 9, some bags merely have a check valve flap 44 in the bottom wall thereof and a spout 46 which functions in the same manner as spout 18. With bags of this type of construction the casing 30 can be suspended from the bag by means of straps 48 secured to the bottom wall 50 of the bag. The hooks 38 at the upper end of hopper 32 can be detachably secured to the lower ends of straps 48.

I claim:

1. In combination a bag having a bottom wall provided with a discharge opening located generally at the central portion thereof, a flexible tubular discharge spout extending downwardly from said opening, said discharge spout being collapsible to close said opening and extendable to open the discharge opening, support means on the bag spaced around said discharge spout, a discharge valve casing and means detachably suspending said casing from said support means in a position aligned with and spaced below said discharge opening, said spout, when extended from the collapsed condition, extending downwardly into said valve casing and a valve member on said casing located below the lower end of the extended spout so that it is operable both to permit and to arrest flow of the contents of the bag downwardly therethrough while the spout is in said extended position.

2. The combination set forth in claim 1 wherein said bottom wall slopes downwardly and inwardly from its outer periphery to said discharge opening.

3. The combination set forth in claim 1 wherein said valve casing comprises a hopper having an open upper end.

4. The combination set forth in claim 3 wherein said suspension means support the valve casing so that its upper open end is spaced from and below the bottom wall of the bag to define a laterally open clearance space therebetween which enables manual access to the collapsed spout for extending the same downwardly and thereby permit the contents of the bag to be discharged into the valve casing.

5. The combination set forth in claim 4 wherein the suspension means comprise a plurality of individual members spaced apart around the periphery of the spout.

6. The combination set forth in claim 1 including a flexible tubular boot projecting downwardly from the bottom wall of the bag and surrounding said tubular spout, said support means being secured to said boot.

7. The combination set forth in claim 6 wherein the spout member is dimensioned in length so that when fully extended it projects downwardly beyond the lower end of the boot.

8. The combination set forth in claim 7 wherein the suspension means comprises a plurality of individual members spaced around the periphery of the boot and extending downwardly therefrom to a level below the lower end of the boot, said valve casing being connected with the lower ends of said suspension members.

9. The combination set forth in claim 8 wherein said boot is collapsible to a condition wherein it underlies the collapsed spout and including means for retaining the boot in said collapsed condition.

10. The combination set forth in claim 8 wherein said support means comprises a plurality of grommets spaced around the lower end portion of said boot and said suspension means comprises a plurality of hook members extending upwardly from the upper end of the casing and detachably connected at their upper ends with said grommets.

11. The combination set forth in claim 6 including a liner in said bag, said tubular spout defining a bottom discharge opening on the liner.

12. The combination set forth in claim 6 wherein the upper end of the spout is secured to the inner periphery of said boot.

13. The combination set forth in claim 6 wherein the upper end of the spout is secured to the inner periphery of said boot above the lower end of the boot.

14. The combination set forth in claim 1 wherein said suspension means comprises a plurality of individual straps connected at their upper ends to the bottom wall of the bag and at their lower ends to the valve casing.

15. The combination set forth in claim 14 wherein one end of each strap is detachably connected to either the bottom wall of the bag or the valve casing.

* * * * *